US006819063B2

(12) United States Patent
Nemirow

(10) Patent No.: US 6,819,063 B2
(45) Date of Patent: Nov. 16, 2004

(54) SENSING VOLTAGE FOR FLUORESCENT LAMP PROTECTION

(75) Inventor: Arthur T. Nemirow, Carson City, NV (US)

(73) Assignee: Bruce Industries, Inc., Dayton, NV (US)

( * ) Notice: Subject to any disclaimer, the term of this patent is extended or adjusted under 35 U.S.C. 154(b) by 0 days.

(21) Appl. No.: 10/318,866

(22) Filed: Dec. 13, 2002

(65) Prior Publication Data

US 2004/0113566 A1 Jun. 17, 2004

(51) Int. Cl.[7] ..... H05B 37/02
(52) U.S. Cl. ..... 315/308; 315/291; 315/DIG. 5
(58) Field of Search ..... 315/129, 291, 315/307, DIG. 2, DIG. 5, 246, 276, 283, 308; 363/21.12, 21.01

(56) References Cited

U.S. PATENT DOCUMENTS

| | | | | | |
|---|---|---|---|---|---|
| 4,641,229 | A | * | 2/1987 | Easter | 363/21.18 |
| 4,668,946 | A | | 5/1987 | Volk et al. | 315/82 |
| 4,870,327 | A | * | 9/1989 | Jorgensen | 315/307 |
| 4,870,529 | A | | 9/1989 | Powell et al. | 315/409 |
| 4,914,355 | A | * | 4/1990 | Mertens et al. | 315/307 |
| 4,949,013 | A | | 8/1990 | Zuchtriegel | 315/106 |
| 5,574,335 | A | | 11/1996 | Sun | 315/119 |
| 5,703,441 | A | | 12/1997 | Steigerwald et al. | 315/307 |
| 5,729,096 | A | | 3/1998 | Liu et al. | 315/225 |
| 5,869,935 | A | | 2/1999 | Sodhi | 315/225 |
| 5,901,051 | A | * | 5/1999 | Takahashi et al. | 363/21.18 |
| 5,952,832 | A | | 9/1999 | Stevanovic et al. | 315/107 |
| 6,140,771 | A | | 10/2000 | Luger et al. | 315/101 |
| 6,175,189 | B1 | | 1/2001 | Brooks | 315/119 |
| 6,366,479 | B1 | * | 4/2002 | Usui et al. | 363/21.12 |

OTHER PUBLICATIONS

Billings, Keith; Switchmode Power Supply Handbook;; 1999; pp. 3.176–3.192; McGraw–Hill.

Power Integrations, Inc. TOP232–234 TOPSwitch–FX Family Design Flexible, EcoSmart®, Integrated Off–Line Switcher, Jan. 2000, pp. 1–36.

* cited by examiner

*Primary Examiner*—Thuy Vinh Tran
(74) *Attorney, Agent, or Firm*—Brooks Kushman P.C.

(57) ABSTRACT

Problems in fluorescent lamp operation are determined by detecting an increase in voltage on a flyback transformer secondary due to the open circuit flyback effect. A ballast implementing the present invention supplies alternating power to ignite and maintain each lamp. DC power is provided to each filament from a multiple output flyback converter. A voltage level is sensed across at least one filament of each lamp. A determination is made that at least one sensed voltage level exceeds a threshold based on the flyback open circuit voltage.

19 Claims, 4 Drawing Sheets

SENSING VOLTAGE FOR FLUORESCENT LAMP PROTECTION

BACKGROUND OF THE INVENTION

1. Field of the Invention

The present invention relates to fluorescent lamps of the preheat or heated filament-type and to electronic ballasts of the type having a filament power supply including a multiple output DC-to-DC converter.

2. Background Art

Fluorescent lamps have found widespread use due, in part, to their efficiency and to their ability to generate light in a variety of hues including cool and warm white. A typical fluorescent lamp is composed of a glass tube containing an inert gas and a small amount of mercury. Phosphors coat the inside of the glass tube. An electrode enters each end of the glass tube. In operation, a ballast provides current to the electrodes. A traditional ballast includes a transformer that uses electromagnetic principles to generate operating and starting voltages for the fluorescent lamps. An electronic ballast uses electronics to achieve the same result. In either case, a high voltage is initially applied to cause a migration of charge between the electrodes. This charge excites the mercury atoms which are in a gaseous state. The mercury atoms release photons in the ultraviolet band. These photons excite the phosphors coating the inside of the glass tube. The phosphors, in turn, release energy as visible light.

One technique for starting a fluorescent lamp involves the use of electrodes with filaments. Each electrode is composed of two conductive pins that extend into the glass tube. The pins are connected inside of the tube by a filament wire including tungsten and boron. Preheating the filament at each end of the fluorescent lamp tube boils electrons from the filament to ionize the gas inside the tube. The ionized gas inside the tube forms a conductive path between the electrodes enabling a voltage placed across the electrodes to establish an electrical arc. Filament preheating techniques increase lamp life, enhance dimming performance and enhance cold operation.

Various approaches have been taken for providing the filament heating power. One existing filament power supply for an electronic ballast uses a steel core transformer as a low frequency transformer to provide filament heating power. The transformer is physically large due to operation at 50 Hz, 60 Hz, or 400 Hz. Primary magnetizing losses and losses in the large turn windings make this approach electrically inefficient. In the event that a lamp filament is shorted, the short is reflected to the transformer primary side, thus shorting the ballast input. Recyclable thermal protection, thermal fuses, or over-current fuses are usually employed to prevent overheating of the ballast during this condition.

Another existing filament power supply for an electronic ballast uses a DC output flyback converter. The flyback converter topology reduces component count and accommodates multiple outputs. The use of high frequency power conversion in a flyback converter reduces the size and weight of the power transformer. The electrical efficiency is improved over a steel core filament power supply transformer.

Use of a high frequency switch mode converter to generate filament voltages has historically not been practical due to circuit complexity and cost. Recent advances in technology make this approach more viable. Accordingly, electronic ballasts of the type having a filament power supply including a DC output flyback converter are desirable for some preheat or heated filament-type fluorescent lamp applications.

A particular problem faced in the fluorescent lamp industry is violent end-of-life lamp failure in certain applications caused by overheating of a broken or disconnected filament. Another particular problem faced in the fluorescent lamp industry is lamp-to-contact high voltage arcing caused by a loose or misinstalled lamp or an excessively worn or damaged lamp socket. Another particular problem faced in the fluorescent lamp industry is smoldering in lamp holders that have suffered heavy carbonization during lamp operation.

To address these problems, some existing approaches detect when an arcing event is taking place and then shut down the ballast high voltage, constant current generator supplying the lamp operating voltage. Such an approach, by design, requires that an arc occur so that it can be detected. These approaches may fail to detect a smoldering lamp or an uninstalled lamp. In addition, initial arcing may not be prevented.

Thus, there is a need for improved operation of fluorescent lights that can detect various failure modes. Such operation should not increase lamp operating costs, cause excessive complexity in lamp ballasts, or decrease reliability.

SUMMARY OF THE INVENTION

The present invention provides a flyback converter for driving lamp filaments. Problems in lamp operation are determined by detecting an increase in voltage on the transformer secondary due to the open circuit flyback effect.

In carrying out the above objects, a method of operating at least one fluorescent lamp having at least one filament is provided. Alternating power to ignite and maintain each lamp is supplied. Also, DC power is provided to each filament from a multiple output flyback converter. Each output of the flyback converter exhibits a flyback open circuit voltage. A voltage level is sensed across at least one filament of each fluorescent lamp. A determination is made that at least one sensed voltage level exceeds a threshold based on the flyback open circuit voltage.

In an embodiment of the present invention, the alternating power is removed from a particular fluorescent lamp if the sensed voltage level for any filament of that lamp exceeds the threshold. Alternatively, alternating power may be removed from all fluorescent lamps if the sensed voltage for any filament of any fluorescent lamp exceeds the threshold.

In another embodiment of the present invention, an indication is provided if any sensed voltage level exceeds a threshold.

In yet another embodiment of the present invention, sensing a voltage level includes asserting an optical emitter in an opto-coupler placed in a circuit across each of the filaments. The threshold may be set with a precision voltage reference in series with the opto-coupler optical emitter.

In various embodiments where at least one fluorescent lamp has two filaments, voltage may be sensed across either one or both filaments.

A system for operating at least one fluorescent lamp is also provided. A high voltage, constant current source strikes and ballasts each fluorescent lamp. A DC flyback converter has at least one secondary output. Each secondary output supplies at least one filament. Each secondary output experiences elevated open circuit voltage under no load conditions. A voltage sensor is placed across each of at least one secondary output. The voltage sensor provides an output signal indicating when sensed voltage exceeds a threshold value.

In an embodiment of the present invention, sensor output signals are logically ORed.

A ballast is also provided. The ballast includes a DC flyback converter with at least one secondary output for driving a lamp filament. Each secondary output exhibits flyup voltage. A voltage sensor across each secondary output asserts a sensor output when flyup voltage is sensed.

In an embodiment of the present invention, a controller removes power from at least one lamp when flyup voltage is sensed on a filament contained in that lamp. The controller may automatically reapply power to the lamp at least once.

The above objects and other objects, features, and advantages of the present invention are readily apparent from the following detailed description of the preferred embodiments when taken in connection with the accompanying drawings.

DETAILED DESCRIPTION OF THE PREFERRED EMBODIMENTS

Figure 1:
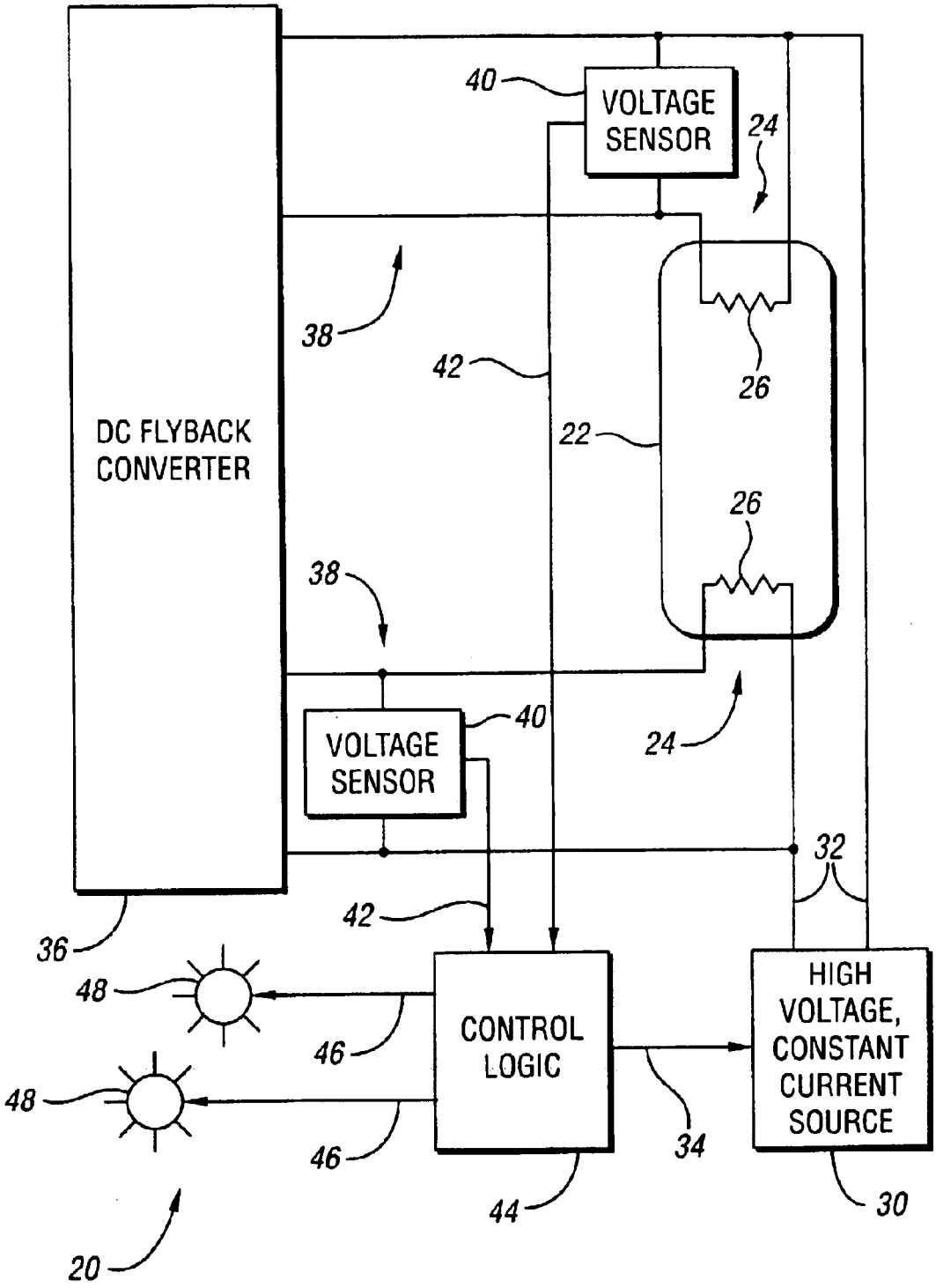
FIG. 1 is a block diagram illustrating a fluorescent light system according to an embodiment of the present invention.

Referring to FIG. 1, a block diagram illustrating a fluorescent light system according to an embodiment of the present invention is shown. The system, shown generally by 20, is typically implemented as a ballast supporting one or more fluorescent lights 22. Each fluorescent light 22 includes one or more electrodes, shown generally by 24. Each electrode 24 includes filament 26.

Fluorescent light system 20 includes high voltage, constant current source 30 providing alternating power to strike and ballast fluorescent light 22. Source 30 generates high voltage for striking lamp 22 then supplies constant alternating current to maintain the arc in fluorescent light 22. Each electrode 24 in light 22 is connected to source 30 by power lead 32. Power control signal 34 determines whether source 30 supplies power to fluorescent light 22. For simplicity, only one lamp 22 is shown in FIG. 1. However, fluorescent light system 20 may support any number of lights 22. In this case, each light 22 may have its own power control signal 34. Alternatively, all lights 22 may be controlled by a single power control signal 34. The design of source 30 is well known in the art of fluorescent lighting. As will be recognized by one or ordinary skill in the art, the present invention will work with a wide variety of designs for source 30.

Fluorescent light system 20 includes DC flyback converter 36 supplying DC power to filaments 26 in lamp 22. In the embodiment shown, each filament 26 is driven by a dedicated secondary stage 38 of flyback converter 36. It is also possible to drive more than one filament 26 with any given secondary stage 38. Voltage sensor 40 is connected across secondary stage 38 for at least one filament 26 in each fluorescent light 22. Each voltage sensor 40 has sensor output 42. Voltage sensor 40 may be an analog sensor outputting a signal on sensor output 42 proportional to the voltage across secondary stage 38. Preferably, voltage sensor 40 generates a binary signal on output 42 indicating whether or not the voltage across secondary stage 38 exceeds a threshold voltage.

Control logic 44 receives sensor output 42 and may perform a variety of functions. For example, control logic 44 may generate one or more indicator signals 46 reflecting the state of voltage sensors 40. Indicator signals 46 may be used to drive indicators 48 or additional control circuitry. Each secondary stage 38 may have its own indicator 48 or a single indicator 48 may be asserted if any secondary stage 38 exhibits elevated voltage. Alternatively, a single indicator 48 may flash a different number of times, a different rate, or in a different pattern to indicate which secondary stage 38 is problematic. Control logic 44 may also generate one or more power control signals 34 to disable or enable alternating power to one or more lamps 22.

Various algorithms for controlling source 30 are possible. For example, alternating power may be removed from a particular fluorescent lamp 22 if the sensed voltage level for any filament 26 for that lamp 22 exceeds a threshold. Alternatively, alternating power may be removed from all lamps 22 if the sensed voltage level for any filament 26 of any lamp 22 exceeds a threshold. Once power is removed from one or more fluorescent lamps 22, control logic 44 may automatically reapply power to unpowered lamps 22 at least once. In one mode of operation, control logic 44 makes one or at most a small number of attempts to restart lamp 22. Following these unsuccessful attempts, control logic 44 will not assert power control signal 34 for the affected lamps 22 without a reset event. Such a reset event may be supplied manually, may be supplied by powering down all or part of system 20, may be supplied by other logic in communication with control logic 44, or the like. In another scenario, control logic 44 operates in "hiccup mode" wherein attempts are periodically made to restart lamp 22 until filament 26 is restored or the problem triggering voltage sensor 40 is otherwise resolved.

As will be recognized by one of ordinary skill in the art, control logic 44 can have a wide variety of constructions. For example, in simple or inexpensive applications where only indicator lights 48 are required, control logic 44 may easily be constructed of discrete electronic components. For more complex control operations, programmable logic and/or a microprocessor may be used to implement control logic 44.

Figure 2:
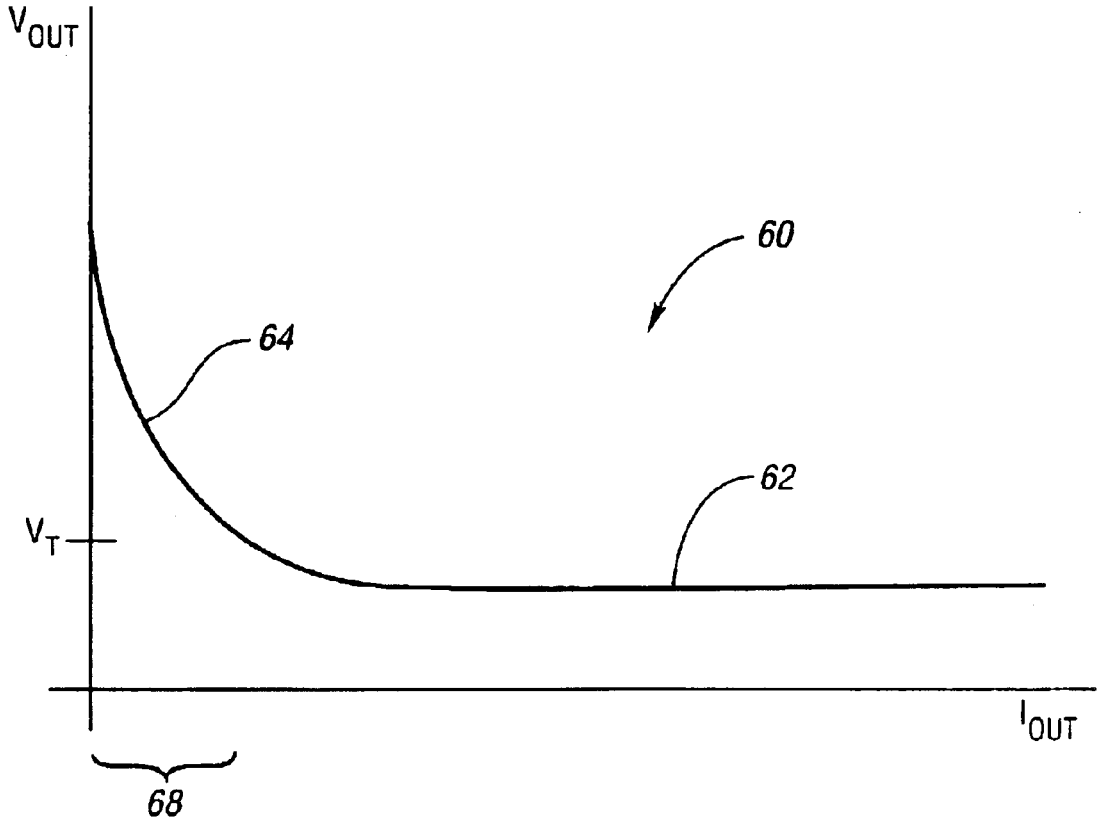
FIG. 2 is a graph illustrating flyback secondary output voltage as a function of output current.

Referring now to FIG. 2, a graph illustrating flyback secondary output voltage as a function of output current is shown. A conceptualized I-V graph, shown generally by 60, includes regions 62 of relatively constant current for fixed load. At approximately 5% of full load condition, secondary stage 38 of flyback converter 36 begins experiencing an increase in voltage. As output current $I_{OUT}$ decreases, output voltage $V_{OUT}$ increases, as shown in flyback portion 64. A threshold voltage, $V_T$, is set to define a no-load region of operation, as indicated by 68. The terms "no-load" and "open circuit" as used in this application refer to a region of operation in which flyback voltage exceeds threshold voltage $V_T$.

Figure 3:
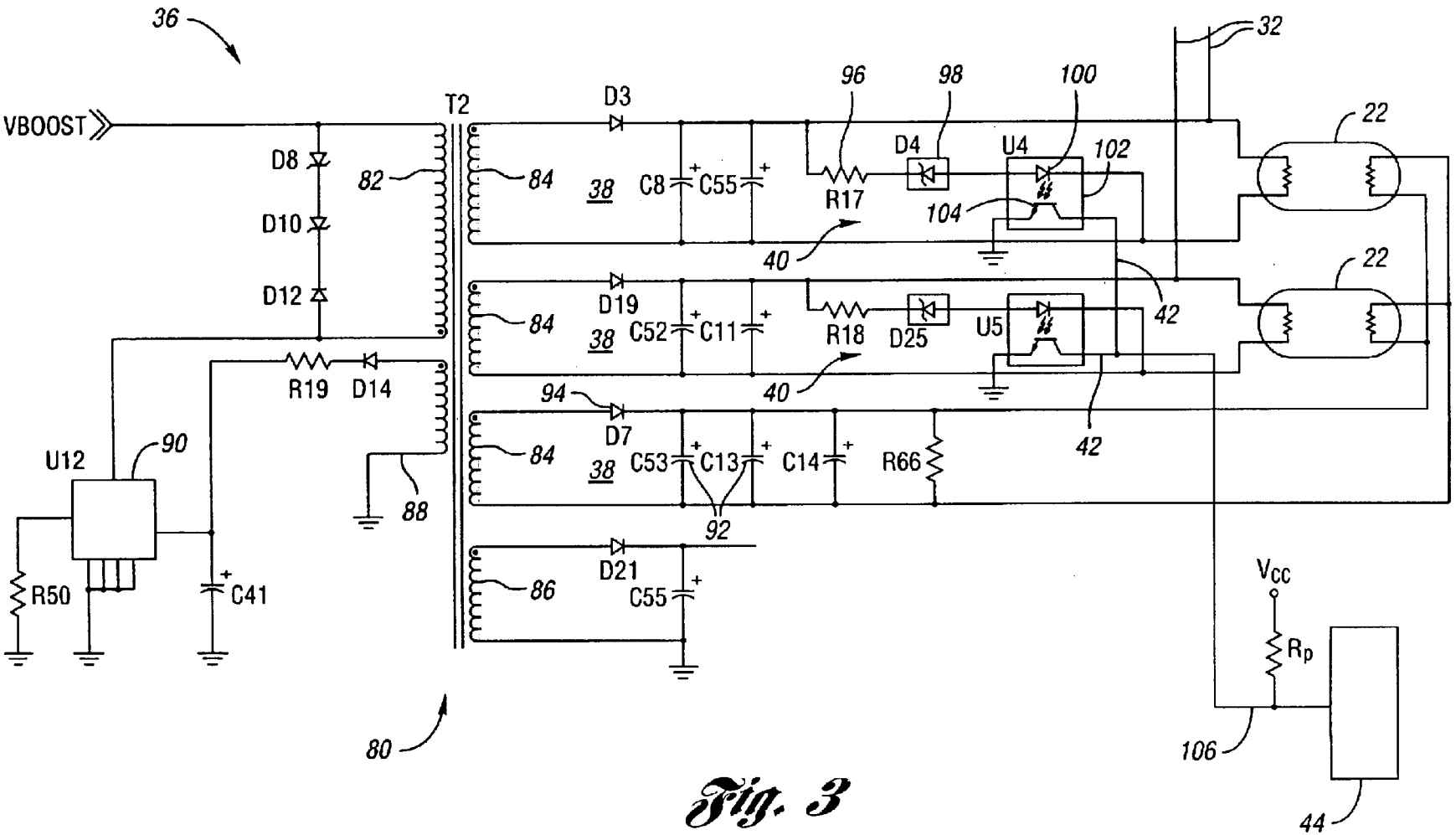
FIG. 3 is a schematic diagram illustrating a flyback converter according to an embodiment of the present invention.

Referring now to FIG. 3, a schematic diagram illustrating a flyback converter according to an embodiment of the present invention is shown. Flyback converter 36 includes a flyback transformer, shown generally by 80. Flyback transformer 80 has primary winding 82, a plurality of filament secondary windings 84, housekeeping voltage secondary winding 86, and control secondary winding 88.

A usually undesirable feature of flyback transformer 80 occurs when output load is disconnected. Under this condition, output voltage increases by a factor of two or more. In the present invention, this otherwise undesirable feature is used to sense a variety of fault conditions including missing or misinstalled lamp 22, damaged filament 26, carbonized lamp sockets, and the like.

The no-load voltage effect is enhanced by minimizing the coupling between primary winding 82 and secondary windings 84. Minimizing coupling between primary winding 82 and secondary windings 84 decreases the voltage load regulation in secondary stages 38. Another benefit of poor secondary-to-primary coupling is the development of leakage inductance that limits secondary short circuit current. Minimizing secondary-to-secondary winding coupling reduces cross-regulation effects. This minimizes the effect one secondary stage 38 has on other secondary stages 38. As such, converter 36 may be said to be operating as a loosely coupled supply.

Preferably, a large number of turns on primary winding 82 and a small number of turns on secondary winding 84 allow the use of insulated wire on secondary windings 84. This permits ease of manufacture and eliminates taping of winding layers. In addition, the present invention eliminates the need for interleaving, or burying secondary windings 84 between equal "halves" of primary winding 82. Typical flyback construction techniques use interleaving to increase coupling and decrease leakage. The present invention takes advantage of loose coupling which results in increased flyback voltage.

Flyback transformer 80 may be wound on an RM8 bobbin with a gapped center leg RM8 core, providing a very compact form factor. This bobbin also provides excellent performance repeatability from winding-to-winding due to reduced leakage inductance effects. A large gap such as, for example, 40 mils, allows for a looser gap tolerance, reducing manufacturing costs. In an embodiment of the present invention, primary winding 82 comprises 110 turns of 34 AWG wire. Each filament secondary winding 84 comprises 7 turns of 30 AWG wiring. Housekeeping voltage secondary winding 86 comprises 20 turns of 32 AWG wiring and control secondary winding 88 comprises 10 turns of 32 AWG wiring.

Flyback converter 36 functions as a DC-to-DC converter. Switching circuit 90 chops the DC voltage supplied to primary winding 82. This switching circuit may be provided by a TOP233 Top Switch from Power Integrations, Inc. of Sunnyvale, Calif. This circuit switches at a basic rate of 133 kHz, which is dithered slightly in frequency by switch circuit 90 to help mitigate the effects of conducted and radiated EMI. Flyback control is implemented using current feedback from control secondary winding 88 through diode D14, resistor R19, and capacitor C41. Primary winding 82 may be driven from a high voltage source. This source may be the PFC boost voltage (VBOOST), up to 400 V, or may be obtained from a full-wave rectified line connected input. Primary clamp components D8, D10 and D12 limit peak drain voltage to a safe value.

The embodiment illustrated in FIG. 3 drives two lamps 22 with three secondary stages 38. Each secondary stage 38 includes filament secondary winding 84 charging two capacitors 92 through diode 94. The two lamps 22 are connected in series with regard to power leads 32 from alternating power supply 30. One filament 26 from each lamp 22 is connected in parallel and is driven by one secondary stage 38. The remaining filament of each lamp 22 is driven by its own secondary stage 38. Each of these latter two secondary stages 38 includes voltage sensor 40. In the embodiment shown, voltage sensor 40 includes a series circuit of current limiting resistor 96, voltage reference 98, and emitter 100 of opto-coupler 102 connected across the output of secondary stage 38 and in parallel with filament 26. Emitter 100 is optically coupled to receiver 104 in opto-coupler 102. Receiver 104 asserts sensor output 42 when current through emitter 100 causes emitter 100 to emit light. In the embodiment shown, voltage reference 98 is a 3.3 V precision band gap reference.

One additional advantage of the present design is short circuit protection. A short circuit across secondary stage 38 is reflected to the primary stage. This permits the use of a smaller diode in secondary stage 38. Switching circuit 90 senses the reflected short and performs a remedial function, such as shutting down flyback converter 36 until a reset occurs, entering a "hiccup mode" wherein flyback converter is periodically started to test for continuing presence of the short, or the like.

The embodiment shown in FIG. 3 is a special case wherein six wires are used to drive two lamps 22. Such six wire fixtures find common application in industry. This is a low cost implementation useful for detecting missing lamp 22 or open circuit conditions on one of two sockets for each lamp 22. Preferably, each filament 26 is monitored individually, as illustrated in FIG. 1. As will be recognized by one of ordinary skill in the art, the circuit illustrated in FIG. 3 can be readily adapted to a wide variety of lamp configurations.

In the embodiment shown in FIG. 3, outputs 42 from sensors 40 are wire ORed to produce input signal 106 for control logic 44. Pull-up resistor $R_p$ holds input signal 106 high when neither sensor output 42 is asserted.

Flyback converter 36 includes housekeeping voltage secondary winding 86 for supplying voltage to control operations such as provided by control logic 44.

Switching circuit 90 implements a TOP233 Top Switch (U12) with drain input connected to primary winding 82, source input connected to ground, multifunction input connected through R50 to ground and control input connected to control secondary winding 88. Typical values for the remaining components in FIG. 3 are provided in Table 1.

TABLE 1

| Typical Component Values | |
|---|---|
| D8, D10 | SMCJ100A |
| D12 | US1M |
| R50 | 30.0 kΩ |
| C41 | 47 μf |
| R19 | 39.0 Ω |
| D14, D21 | US1G |
| D3, D7, D19 | EGP50D |
| C8, C11, C13, C14, C52, C53, C58 | 68 μf, 10 V |
| C55 | 680 μf, 25 V |
| R17, R18 | 1.50 kΩ |
| R66 | 390 Ω, ½ W |
| D4, D25 | ZRC330F, 3.3 V |
| U4, U5 | PS2701-1L |

Figure 4:
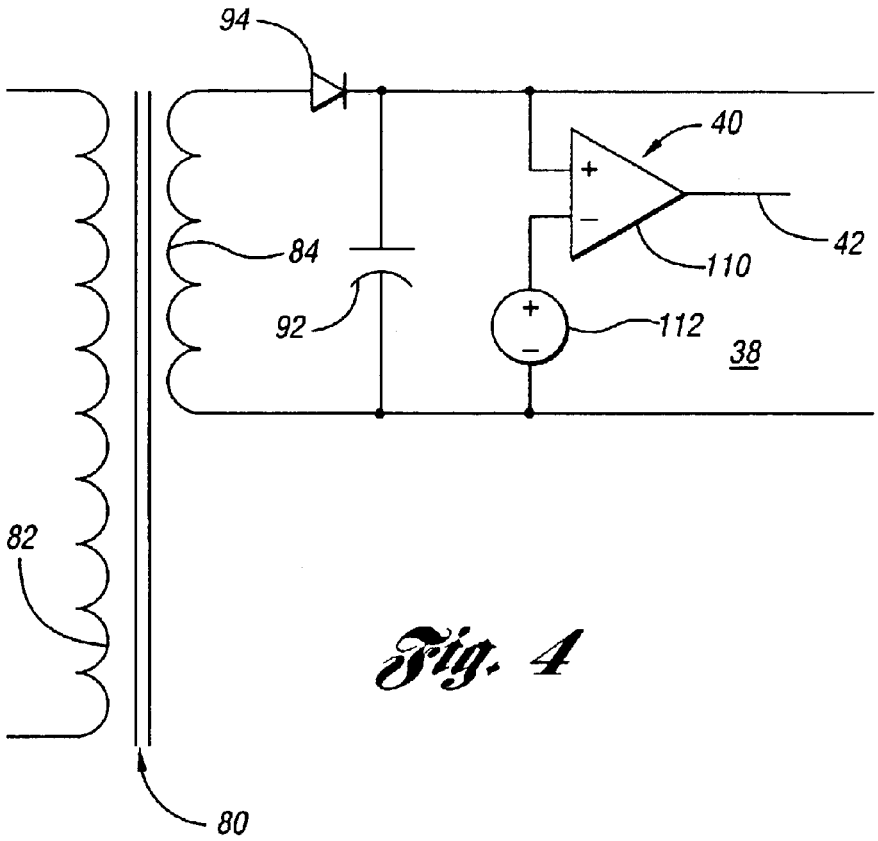
FIG. 4 is a schematic diagram illustrating a fixed voltage comparator voltage sensor according to an embodiment of the present invention.

Referring now to FIG. 4, a schematic diagram illustrating a fixed voltage comparator voltage sensor according to an embodiment of the present invention is shown. Voltage sensor 40 may be implemented with comparator 110 and reference voltage 112. Reference voltage 112 is set to threshold voltage $V_T$. When the voltage across secondary stage 38 exceeds $V_T$, comparator 110 asserts sensor output 42.

Figure 5:
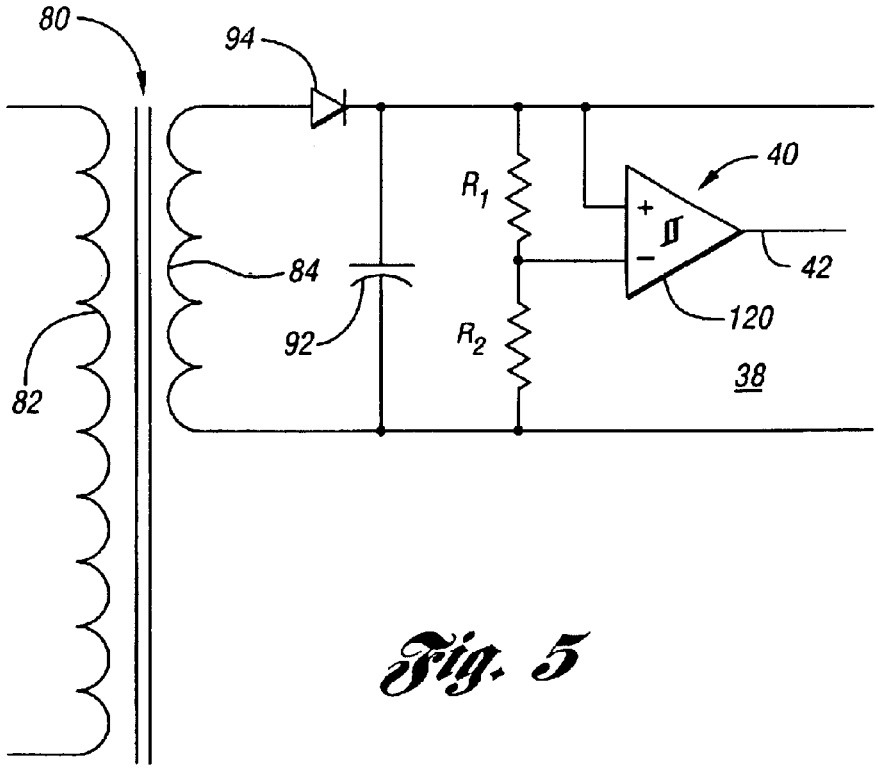
FIG. 5 is a schematic diagram illustrating a relative voltage comparator voltage sensor according to an embodiment of the present invention.

Referring now to FIG. 5, a schematic diagram illustrating a relative voltage comparator voltage sensor according to an embodiment of the present invention is shown. Hysteretic comparator 120 triggers at an input voltage differential set at some voltage greater than zero. Resistors $R_1$ and $R_2$ establish a voltage divider at the negative input of comparator 120. The voltage divider is adjusted to trigger comparator 120 when the output of secondary stage 38 exceeds the threshold voltage $V_T$, as in the following equation:

$$V_T = V_C \frac{R_1 + R_2}{R_2}$$

where $V_C$ is the trigger voltage of hysteretic comparator 120.

In the embodiments illustrated in FIGS. 4 and 5, an opto-coupler is preferably used to maintain isolation between filaments 22 and between each filament 22 and control logic 44, as needed. Other isolation techniques such as, for example, an isolation transformer, may also be used.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of operating at least one fluorescent lamp, each fluorescent lamp having at least one filament, the method comprising:

supplying alternating power to ignite and maintain each fluorescent lamp;

providing a DC power to each filament, the DC power provided from a multiple output flyback converter, each output of the flyback converter exhibiting a flyback open circuit voltage;

sensing a voltage level across the at least one filament of each fluorescent lamp; and determining that at least one sensed voltage level exceeds a threshold, the threshold based on the flyback open circuit voltage.

2. A method of operating at least one fluorescent lamp as in claim 1 further comprising removing the alternating power from a particular fluorescent lamp of the at least one flourescent lamp if the sensed voltage level for any filament of the particular fluorescent lamp exceeds the threshold.

3. A method of operating at least one fluorescent lamp as in claim 1 further comprising removing the alternating power from all fluorescent lamps if the sensed voltage level for any filament of any fluorescent lamp exceeds the threshold.

4. A method of operating at least one fluorescent lamp as in claim 1 further comprising providing an indication if any sensed voltage level exceeds the threshold.

5. A method of operating at least one fluorescent lamp as in claim 1 wherein sensing a voltage level comprises asserting an optical emitter in an opto-coupler placed in a circuit across each of the at least one filament.

6. A method of operating at least one fluorescent lamp as in claim 5 wherein the threshold is set with a precision voltage reference in series with the opto-coupler optical emitter.

7. A method of operating at least one fluorescent lamp as in claim 1 wherein the at least one fluorescent lamp has two filaments across each of which voltage is sensed.

8. A method of operating at least one fluorescent lamp as in claim 1 wherein the at least one fluorescent lamp has two filaments across only one of which voltage is sensed.

9. A system for operating at least one fluorescent lamp, each fluorescent lamp having at least one filament, the system comprising:

a high voltage, constant current source for striking and ballasting each fluorescent lamp;

a DC flyback converter having at least one of secondary output, each secondary output supplying the at least one filament, each secondary output experiencing elevated voltage under substantially no load conditions; and a voltage sensor across each of at least one secondary output, the voltage sensor providing an output signal indicating when sensed voltage exceeds a threshold value.

10. A system for operating at least one fluorescent lamp as in claim 9 wherein the voltage sensor comprises a precision voltage reference in series with an opto-coupler emitter.

11. A system for operating at least one fluorescent lamp as in claim 9 wherein the at least one voltage sensor is a plurality of voltage sensors.

12. A system for operating at least one fluorescent lamp as in claim 11 wherein the output signals are logically ORed.

13. A system for operating at least one fluorescent lamp as in claim 9 further comprising a controller in communication with an output of each voltage sensor, the controller operative to remove a high voltage, constant current source from a particular fluorescent lamp of the at least one flourescent lamp based on the output signal from the voltage sensor monitoring the at least one secondary output connected to one of the at least one filament of the particular fluorescent lamp.

14. A system for operating at least one fluorescent lamp as in claim 9 further comprising a controller in communication with an output of each voltage sensor and an indicator corresponding to each voltage sensor, the controller asserting the indicator when the corresponding voltage sensor sense voltage exceeding the threshold value.

15. A system for operating at least one fluorescent lamp as in claim 9 wherein a short circuit across any secondary output is reflected to a primary side of the DC flyback converter, the system further comprising a switching circuit shutting down operation of the DC flyback converter.

16. A ballast comprising:

a DC flyback converter having at least one secondary output for driving a lamp filament, each secondary output exhibiting a flyup voltage; and a voltage sensor across the at least one secondary output, the voltage sensor asserting a sensor output when the flyup voltage is sensed, the voltage sensor comprising an opto-coupler having a light emitter and a receiver, the receiver generating the sensor output based on light received from the light emitter, a current limiting resistor connected in series with the light emitter and a reference voltage connected in series with the light emitter.

17. A ballast as in claim 16 further comprising an indicator corresponding with each voltage sensor, each indicator asserting based on the corresponding voltage sensor output.

18. A ballast as in claim 16 further comprising:

a power supply supplying alternating current to drive at least one lamp; and a controller in communication with each voltage sensor and the power supply, the controller removing power from the at least one lamp when the flyup voltage is sensed on the filament contained in the at least one lamp.

19. A ballast as in claim 18 wherein the controller is further operative to automatically reapply power to the at least one lamp at least once.

* * * * *